US009487876B2

(12) United States Patent
Yadav et al.

(10) Patent No.: US 9,487,876 B2
(45) Date of Patent: Nov. 8, 2016

(54) EFFECT OF OPERATING PARAMETERS ON THE PERFORMANCE OF ELECTROCHEMICAL CELL IN COPPER-CHLORINE CYCLE

(75) Inventors: Ganapati Dadasaheb Yadav, Mumbai (IN); Prakash Santoshrao Parhad, Mumbai (IN); Ashwini Bhagavan Nirukhe, Munbai (IN); Parvatalu Damaraju, New Delhi (IN); Anil Bhardwaj, New Delhi (IN); Bantwal Narayana Prabhu, New Delhi (IN); Nuzhath Joeman Thomas, New Delhi (IN); Dilip Madhusudan Kale, New Delhi (IN)

(73) Assignees: INSTITUTE OF CHEMICAL TECHNOLOGY, East Mumbai (IN); ONGC ENERGY CENTRE TRUST OIL AND NATURAL GAS CORPORATION, New Delhi (IN)

( * ) Notice: Subject to any disclaimer, the term of this patent is extended or adjusted under 35 U.S.C. 154(b) by 261 days.

(21) Appl. No.: 14/131,312

(22) PCT Filed: Jul. 9, 2012

(86) PCT No.: PCT/IN2012/000485

§ 371 (c)(1),
(2), (4) Date: Apr. 28, 2014

(87) PCT Pub. No.: WO2013/054341

PCT Pub. Date: Apr. 18, 2013

(65) Prior Publication Data

US 2014/0353165 A1 Dec. 4, 2014

(30) Foreign Application Priority Data

Jul. 8, 2011 (IN) ..... 1974/MUM/2011

(51) Int. Cl.
*C25C 1/12* (2006.01)
*C25C 7/04* (2006.01)

(Continued)

(52) U.S. Cl.
CPC . *C25C 7/04* (2013.01); *C25C 1/12* (2013.01); *C25C 7/00* (2013.01); *C25C 7/02* (2013.01)

(58) Field of Classification Search
CPC ..... C25C 1/12
See application file for complete search history.

(56) References Cited

U.S. PATENT DOCUMENTS 2,964,453 A * 12/1960 Garn ..... C23F 1/46 204/208
3,764,490 A 10/1973 Chambers
4,028,199 A * 6/1977 Holland ..... C02F 1/46109 204/218

(Continued)

FOREIGN PATENT DOCUMENTS

EP 0161224 11/1985
GB 1124222 8/1968

(Continued)

OTHER PUBLICATIONS

International Search Report issued in PCT/IN2012/000485, mailed Feb. 7, 2013 (3 pages).

*Primary Examiner* — Harry D Wilkins, III
(74) *Attorney, Agent, or Firm* — Fish & Richardson P.C.; Vasily A. Ignatenko

(57) ABSTRACT

The electrolysis of cuprous chloride was carried out in the electrochemical cell. The particle size, current density, cathodic current efficiency, conversion of cuprous chloride and yield of copper formed depends strongly on current flow, heat transfer and mass transfer operation. The current flow, heat transfer and mass transfer are depends on surface area ratio of anode to cathode, distance between electrodes, concentration of HCl, applied voltage, flow rate of electrolyte, CuCl concentration and reaction temperature. The electrolysis of cuprous chloride as a part of Cu—Cl thermochemical cycle for hydrogen production is experimentally demonstrated in proof-of-concept work.

25 Claims, 5 Drawing Sheets

(51) Int. Cl.
*C25C 7/00* (2006.01)
*C25C 7/02* (2006.01)

(56) References Cited

U.S. PATENT DOCUMENTS 4,242,193 A * 12/1980 Moeglich ..... B01D 61/50 204/252
2004/0140222 A1* 7/2004 Smedley ..... C25C 1/00 205/337
2005/0067291 A1* 3/2005 Haiki ..... C25C 5/02 205/111
2008/0283390 A1 11/2008 Fan et al.
2010/0025260 A1 2/2010 Naterer et al.
2010/0051469 A1 3/2010 Stolberg

FOREIGN PATENT DOCUMENTS

JP 56119776 A 9/1981
JP 60128279 A 7/1985

* cited by examiner (a)

(b)

EFFECT OF OPERATING PARAMETERS ON THE PERFORMANCE OF ELECTROCHEMICAL CELL IN COPPER-CHLORINE CYCLE

FIELD OF THE INVENTION

The present invention relates to the effect of various operating parameters such as are surface area ratio of anode to cathode, distance between electrodes, concentration of HCl, applied voltage, flowrate of electrolyte, CuCl concentration and reaction temperature on the performance of the electrochemical cell. In present copper-chlorine cycle for hydrogen production, electrolysis of cuprous chloride to copper powder in cathode side and formation of cupric chloride in anode side is one of the main reactions.

BACKGROUND OF THE INVENTION

Recovery of metal from electrolyte using electrolysis is in practice by many industries like plating, mining and metal finishing. Recovery of copper from the solutions containing copper metal in the form of ions is well known process (JP2004244663 (A), WO2009090774 (A1)). Present invention relate about study of electrolysis as a main reaction in the copper-chlorine cycle in which copper is formed cathode and cupric chloride get produced on anode.

An electrolytic apparatus and process for the online regeneration of acid cupric chloride etching baths used in printed circuit board fabrication is described. The copper metal etched into the system is completely removed. Graphite and/or carbon material is used as cathode and anode. Micro porous separator is used for separation of anolyte and catholyte solution (US005421966A).

US2008/0283390A1 describes a method for electrolysis of cuprous chloride to produce copper powder and cupric chloride for Cu—Cl thermochemical cycle. Dense graphite electrodes are used as working electrodes as anode and cathode. Anion exchange membrane made from poly and polyethylenimine cross-linked is used as a separating medium. The electrodes are designed in the form of channels rib manner. The electrolyte flows through the respective channels. The main problem is the removal of copper powder formed during the electrolysis. The different additives have been used to enhance the solubility of CuCl. To increase the conductivity the solution was seeded with carbon black material.

US2010/051469A1 used electrochemical cell for production of hydrogen gas at cathode and cupric chloride at anode electrode from the electrolysis of cuprous chloride and HCl. The anolyte and catholyte used are cuprous chloride in hydrochloric acid and water respectively. Cation exchange membrane is used as separating medium between the anode and cathode compartment.

One of the main challenges of this process is to achieve high efficiency during the electrolysis of CuCl. Main difficulty in the electrolysis of cuprous chloride to copper powder formation and cupric chloride formation is removal of copper powder formed on the cathode electrode and formation of cupric chloride by competing reaction between dissolved oxygen and cuprous chloride in the presence of HCl as $$2HCl+2CuCl+0.5O_2 \rightarrow 2CuCl_2+H_2O$$

With increase in HCl concentration, rate of formation of undesired anionic species like $CuCl_2^-$, $CuCl_3^{2-}$ increases.

With decrease in concentration of HCl, there is precipitation of cuprous chloride occur in the cell.

SUMMARY OF THE INVENTION

The present invention relates to electrolysis of cuprous chloride to produce the copper powder in a cathode side and cupric chloride in anode side is carried out in an electrochemical cell. The electrolysis of cuprous chloride was carried out in the electrochemical cell. The particle size, current density, cathodic current efficiency, conversion of cuprous chloride and yield of copper formed depends strongly on current flow, heat transfer and mass transfer operation. The current flow, heat transfer and mass transfer are depends on surface area ratio of anode to cathode, distance between electrodes, concentration of HCl, applied voltage, flow rate of electrolyte, CuCl concentration and reaction temperature. The electrolysis of cuprous chloride as a part of Cu—Cl thermochemical cycle for hydrogen production has been carried out herein.

Thus present invention relates to the process for electrolysis of cuprous chloride to produce copper, wherein at least one anode and at least one cathode of electrochemical cell are contacted with electrolyte in compartment/s and further applying a voltage between anode and cathode to produce copper Present invention further related to design and construction of Electrochemical cell to produce copper, wherein at least one anode and at least one cathode of electrochemical cell are contacted with electrolyte in compartment/s Electrochemical cell disclosed herein for production of copper from cuprous chloride comprises at least one anode disposed in electrolyte; at least one cathode disposed in electrolyte; at least one compartment for electrode and ion exchange membrane disposed between the anode compartment and the cathode compartment.

It is synergistically found that distance between electrodes in the range of 0.01 cm to 100 cm is operating effectively.

BRIEF DESCRIPTION OF THE DRAWINGS

Embodiments of the inventions are described in conjunction with the accompanying FIGURE, wherein.

DETAIL DESCRIPTION OF THE INVENTION

The present invention reveals a method of electrolysis of cuprous chloride to produce copper powder in cathode side and cupric chloride on anode side. The electrolysis of cuprous chloride was carried out in the electrochemical cell. The particle size, current density, cathodic current efficiency, conversion of cuprous chloride and yield of copper formed depends strongly on current flow, heat transfer and mass transfer operation. The current flow, heat transfer and mass transfer are depends on surface area ratio of anode to cathode, distance between electrodes, concentration of HCl, applied voltage, flow rate of electrolyte, CuCl concentration and reaction temperature.

Figure 1:
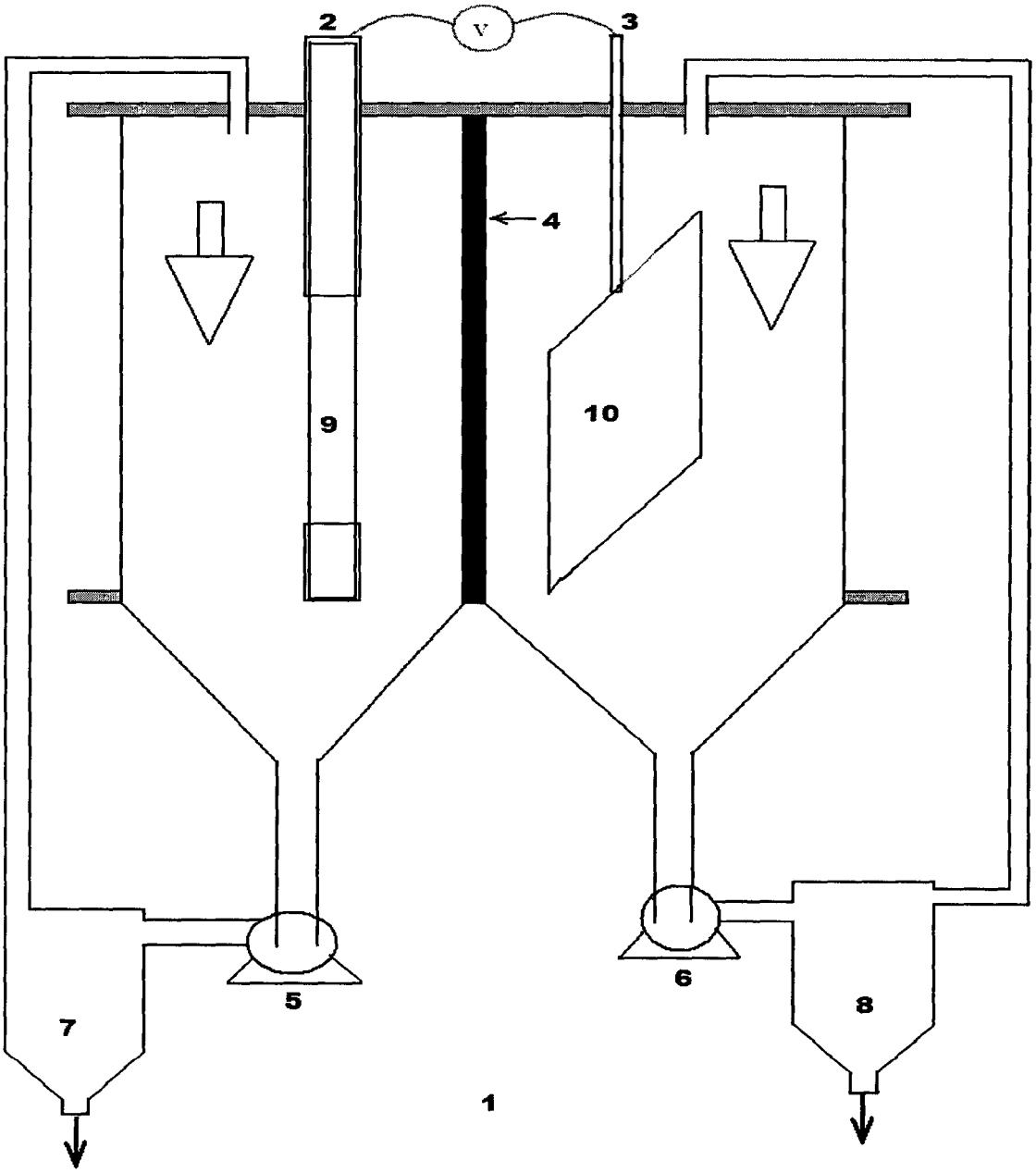
FIG. 1 shows in schematic form an electrochemical cell configuration used in the process of the invention.

Thus present invention relates to the process for electrolysis of cuprous chloride to produce copper, wherein at least one anode and at least one cathode of electrochemical cell are contacted with electrolyte in compartment/s and further applying a voltage between anode and cathode to produce copper Present invention further related to design and construction of Electrochemical cell to produce copper, wherein at least one anode and at least one cathode of electrochemical cell are contacted with electrolyte in compartment/s FIG. 1 describes an electrochemical cell (1) comprises of two half cells having the capacity 600 $cm^3$ made from acrylic to avoid corrosion. These two half cell are separated by ion exchange membrane (4). Two trappers (7&8) are provided to the outlet of anode and cathode half cell. The copper powder formed during electrolysis gets settled at the bottom of the cathode side trapper. Individual closed loop circulation of electrolyte is provided by a peristaltic pump (5 and 6).

Figure 2:
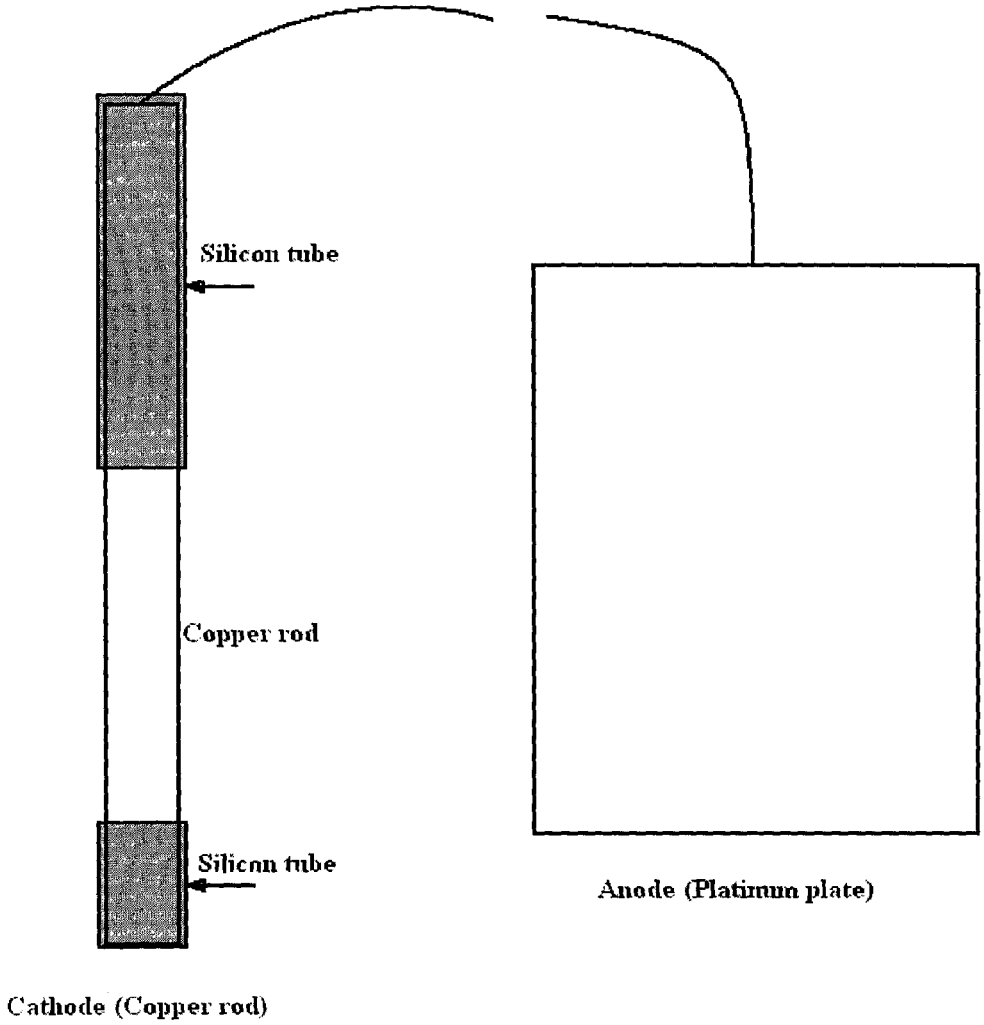
FIG. 2 represent schematic forms of copper cathode and platinum anode used in electrolysis.

FIG. 2 describes half cell, trapper and pump are connected to each other through silicon tube. Copper rod (9) is used as cathode and platinum plate (10) as anode wherein power is supplied by a DC power.

Construction of Electrochemical cell to produce copper, wherein at least one anode and at least one cathode of electrochemical cell are contacted with electrolyte in compartment/s Electrochemical cell discloses herein for production of copper from cuprous chloride comprises at least one anode disposed in electrolyte; at least one cathode disposed in electrolyte; at least one compartment for electrode and ion exchange membrane disposed between the anode compartment and the cathode compartment with the distance between electrodes is in the range of 0.01 cm to 100 cm.

Electrochemical cell of the present invention is composed of corrosion resistant and non conductive material. Such material can be selected from a ceramic, thermoplastic or thermoset polymeric material and any conductive material coated by non conductive materials.

Electrochemical cell of the present invention wherein an anode and cathode are composed of corrosion resistant conductive metals and conductive carbon material. Electrochemical cell is composed of conductive material selected from the group consisting of platinum, palladium, ruthenium, iridium, osmium, rhodium, and graphite. For better results Electrochemical cell with platinum as anode can be used. In constructional features, cathode of Electrochemical cell with a conductive material selected from the group consisting of copper, platinum, palladium, ruthenium, iridium, osmium, rhodium and graphite can be used. For better results Electrochemical cell with copper as cathode can be used.

Surface area of electrodes plays important role in construction of Electrochemical cell. Selective ratio of anode surface to cathode surface can be used is in the range of 0.5:1 to 30:1 to play synergistic effect for better process. This surface area ratio can be preferably about 8:1. In Electrochemical cell, electrolyte is cuprous chloride in hydrochloric acid and anode and cathode are separated by ion exchange membrane. Hydrochloric acid uses in electrolyte has concentration in the range of about 0.1 N to 12 N. This concentration of HCL can be preferably in the range of about 1.5 N to 6 N. For better results of Electrochemical cell, hydrochloric acid having concentration about 2.36 N can also be used. Voltage between anode & cathode can be applied in the range of 0.4 V to 1.5 V which can be preferably in the range of 0.5 V to 1.1 V. But for better results of Electrochemical cell voltage applied can be about 0.7 V.

Thus operating parameters like current density for electrolysis can be in a range from 10 $mA/cm^2$ to 200 $mA/cm^2$. This operating parameter can be preferably in the range from 100 $mA/cm^2$ to 125 $mA/cm^2$. In Cell, Reynolds number based on particle size in the range of 10 to 500 but in anode compartment, Reynolds number based on particle size can be about 300 whereas in cathode compartment, Reynolds number based on particle size can be about 100.

Yet another constructional parameter of Electrochemical cell is that electrolysis is carried out at temperature in the range of 0° C. to 90° C. but electrolysis can also be carried out at temperature preferably in the range of 10° C. to 45° C. For better performance of Electrochemical cell electrolysis temperature can be carried out at about 30° C.

Thus Electrochemical cell for production of copper from cuprous chloride comprising of at least one anode disposed in electrolyte; at least one cathode disposed in electrolyte; at least one compartment for electrode; ion exchange membrane disposed between the anode compartment and the cathode compartment wherein the distance between electrodes is in the range of 0.01 cm to 100 cm.

Electrochemical cell of present invention is composed of corrosion resistant and non conductive material selected from ceramic, thermoplastic or thermoset polymeric material and any conductive material coated by non conductive materials.

Anode and cathode are composed of corrosion resistant conductive metals and conductive carbon material wherein an anode is composed of conductive material selected from the group consisting of platinum, palladium, ruthenium, iridium, osmium, rhodium, and graphite but anode can be platinum.

On other hand cathode is a conductive material and it can be selected from the group consisting of copper, platinum, palladium, ruthenium, iridium, osmium, rhodium and graphite. Copper metal can be cathode in present case.

One of the embodiments of the present invention is that the ratio of anode surface to cathode surface used can be in the range of 0.5:1 to 30:1 and preferably about 8:1.

One of the embodiments of the present invention is that electrolyte is cuprous chloride in hydrochloric acid and anode and cathode are separated by ion exchange membrane.

One of the embodiments of the present invention is that hydrochloric acid has concentration in the range of about 0.1 N to 12 N preferably in the range of about 1.5 N to 6 N more preferably at about 2.36 N.

One of the embodiments of the present invention is that cuprous chloride has concentration in the range of about 0.1 N to 1 N preferably in the range of about 0.1 N to 0.8 N more preferably at about 0.3 N.

One of the embodiments of the present invention is that applied voltage is in the range of 0.4 V to 1.5. V preferably in the range of 0.5 V to 1.1 V and more preferably about 0.7 V.

One of the embodiments of the present invention is that electrolysis is carried out at current density ranging from 10 $mA/cm^2$ to 200 $mA/cm^2$ preferably ranging from 100 $mA/cm^2$ to 125 $mA/cm^2$.

Yet another embodiment of the present invention is that electrochemical cell has Reynolds number based on particle size in the range of 10 to 500 but anode compartment has Reynolds number based on particle size about 300 and cathode compartment has Reynolds number based on particle size about 100.

Yet another embodiment of the present invention is that electrolysis is carried out at temperature in the range of 0° C. to 90° C. preferably in the range of 10° C. to 45° C. and more preferably 30° C.

One of the embodiments of the present invention is that in Electrochemical cell, distance between electrodes is preferably in the range 1 cm to 5 cm.

The present invention reveals a process of electrolysis of cuprous chloride to produce copper powder in cathode side and cupric chloride on anode side carried out in the electrochemical cell. In the process of invention, electrolysis of cuprous chloride is carried out to produce copper, comprising the steps of contacting at least one anode and at least one cathode of electrochemical cell with electrolyte in compartment/s and applying a voltage between anode and cathode to produce copper.

In process for electrolysis of cuprous chloride, a voltage is applied between anode and cathode by keeping distance in the range of 0.01 cm to 100 cm. Electrolyte used in electrolysis is cuprous chloride in hydrochloric acid and anode and cathode are separated by ion exchange membrane.

In process for electrolysis of cuprous chloride, hydrochloric acid has concentration in the range of about 0.1 N to 12 N preferably in the range of about 1.5 N to 6 N and more preferably about 2.36 N.

Further in process for electrolysis of cuprous chloride, applied voltage is in the range of 0.4 V to 1.5 V preferably in the range of 0.5 V to 1.1 V more preferably 0.7 V.

It is found that process for electrolysis of cuprous chloride is carried out effectively at current density ranging from 10 $mA/cm^2$ to 200 $mA/cm^2$ preferably ranging from 100 $mA/cm^2$ to 125 $mA/cm^2$.

Reynolds number based on particle size has effective contribution in a process for electrolysis of cuprous chloride wherein electrochemical cell has Reynolds number based on particle size in the range of 10 to 500 but anode compartment has Reynolds number based on particle size about 300 and cathode compartment has Reynolds number based on particle size about 100.

electrolysis can be carried out effectively at temperature in the range of 0° C. to 90° C. preferably in the range of 10° C. to 45° C. and more preferably about 30° C.

In electrolysis process, anode and cathode have surface area ratio in the range of 0.5:1 to 30:1 preferably about 8:1 by keeping distance between electrodes in the range of 0.01 cm to 100 cm preferably in the range 1 cm to 5 cm.

Another embodiment of the present invention is that in process, electrolyte used is cuprous chloride in hydrochloric acid wherein anode and cathode are separated by ion exchange membrane.

Another embodiment of the present invention is that hydrochloric acid has concentration in the range of about 0.1 N to 12 N. But this range of hydrochloric acid can be preferably used in the range of about 1.5 N to 6 N. Concentration of hydrochloric acid can more preferably used at about 2.36 N.

Another embodiment of process of invention is that the applied voltage is in the range of 0.4 V to 1.5 V but applied voltage can be preferably in the range of 0.5 V to 1.1 V Better result for process of electrolysis of cuprous chloride can be found by applying voltage at 0.7 V.

Another embodiment of process of invention is that process for electrolysis of cuprous chloride is carried out at current density ranging from 1 $mA/cm^2$ to 1000 $mA/cm^2$ more preferably in the range from 100 $mA/cm^2$ to 125 $mA/cm^2$.

Reynolds number based on particle size plays one of the synergistic role in the present process for electrolysis of cuprous chloride. Hence it is found that electrochemical cell has Reynolds number based on particle size in the range of 10 to 500 for synergism. In the process of invention, anode compartment has number about 300 and cathode compartment has Reynolds number based on particle size about 100 in each electrochemical cell.

Another embodiment of process of invention is that electrolysis is carried out at temperature in the range of 0° C. to 90° C. as temperature plays important role in the process. This temperature of electrolysis can be preferably in the range of 10° C. to 45° C. and more preferably about 30° C.

In process of invention surface area of electrodes play important role and wise ratio of each with each other. Hence one of the embodiments of the present invention is that anode and cathode have surface area ratio in the range of 0.5:1 to 30:1. This surface area can be in about 8:1 and distance between electrodes can be preferably in the range 1 cm to 5 cm.

Figure 3:
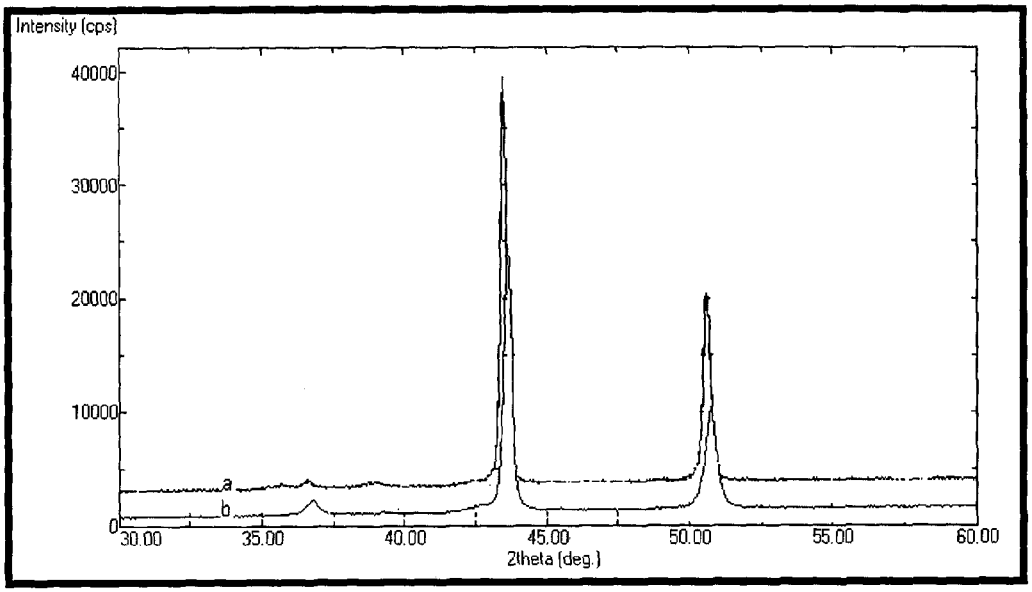
FIG. 3 depicts X-ray diffraction (XRD) pattern of (a) copper powder used in $H_2$ generation reaction and (b) copper powder obtained in electrolysis of CuCl.

X-ray diffraction (XRD) pattern of (a) copper powder used in H2 generation reaction and (b) copper powder obtained in electrolysis of CuCl is shown in FIG. 3.

Figure 4:
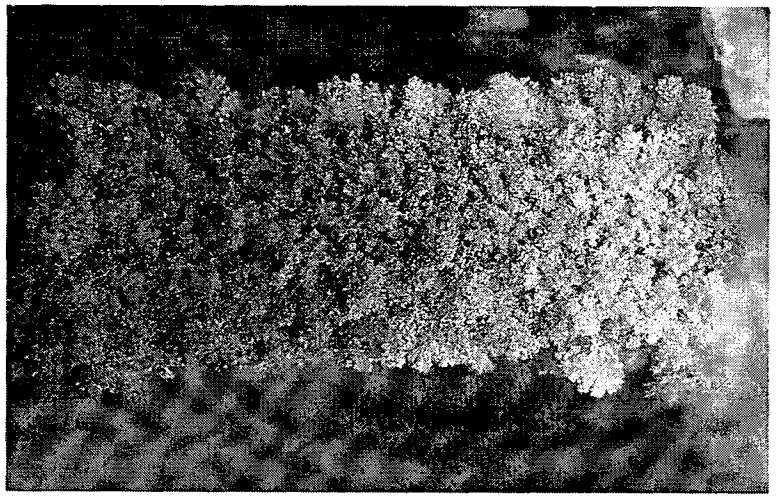
FIG. 4 shows electrolytic deposition of copper powder on copper electrode.
Figure 5:
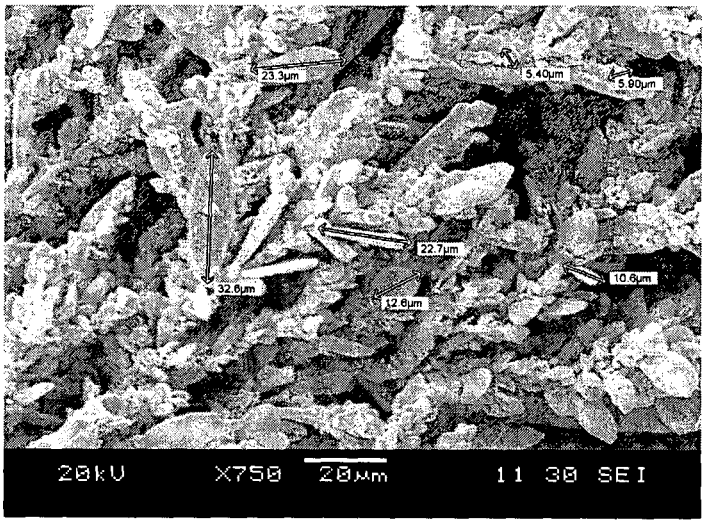
FIG. 5 shows scanning electron microscopy (SEM) images of electrolytically deposited copper powder.
Figure 5:
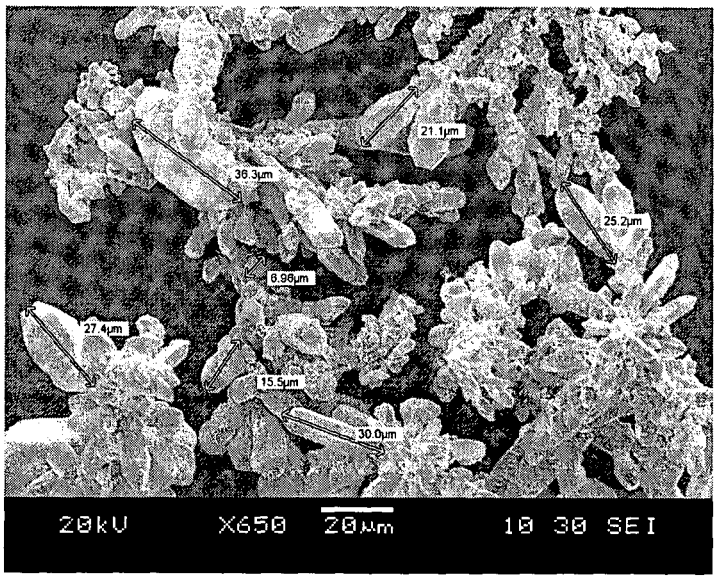

Electrolytic deposition of copper powder on copper electrode is shown in FIG. 4 whereas FIG. 5 shows scanning electron microscopy (SEM) images of electrolytically deposited copper powder

EXAMPLES

Example 1-4

According to the present invention, all experiments were carried out in an electrochemical cell. The circulation of electrolyte was supplied using peristaltic pump. The results for variation of surface area ratio of anode to cathode are presented in Table 1. The reactions are performed in the following operating conditions:

| | |
|---|---|
| Distance between working electrodes: | 4.5 cm |
| Concentration of HCl: | 8N |
| Concentration of CuCl: | 0.2N |
| Voltage applied: | 0.9 V |
| Reaction temperature: | 30° C. |

TABLE 1

| Example No. | Surface area ratio of anode to cathode | Avg. cathode current density ($mA/cm^2$) |
|---|---|---|
| 1 | 2:1 | 33.96 |
| 2 | 4:1 | 39.51 |
| 3 | 6:1 | 58.17 |
| 4 | 8:1 | 67.23 |

The copper powder produced in the electrolysis is compared with copper powder used in hydrogen generation reaction using XRD as shown in FIG. 3. The XRD pattern of electrolytic powder shows similar behavior. The produced powder is 99.99% pure.

The deposition of copper powder on the copper electrode is shown in FIG. 4. The FIG. 5 shows the SEM images of copper powder produced in the electrolysis of cuprous chloride. The size of copper powder obtained is in the range of 6-30 μm. The copper powder obtained is dendritic in shape.

Example 5-11

According to the present invention, all experiments were carried out in an electrochemical cell. The circulation of electrolyte was supplied using peristaltic pump. The results for variation of distance between electrodes are presented in Table 2. The reactions are performed in the following operating conditions:

| | |
|---|---|
| Surface area ratio of anode to cathode: | 12:1 |
| Concentration of HCl: | 5N |
| Concentration of CuCl: | 0.2N |
| Voltage applied: | 0.65 V |
| Reaction temperature: | 30° C. |

TABLE 2

| Example No. | Distance between electrodes (cm) | Avg. cathode current density (mA/cm$^2$) |
|---|---|---|
| 5 | 1 | 33.52 |
| 6 | 1.7 | 34.07 |
| 7 | 2.7 | 41.46 |
| 8 | 3.5 | 67.23 |
| 9 | 4 | 65.92 |
| 10 | 5 | 58.49 |

Example 12-16

According to the present invention, all experiments were carried out in an electrochemical cell. The circulation of electrolyte was supplied using peristaltic pump. The results for variation of concentration of HCl (N) are presented in Table 3. The reactions are performed in the following operating conditions:

| | |
|---|---|
| Surface area ratio of anode to cathode: | 15:1 |
| Distance between electrodes: | 3.5 cm |
| Concentration of CuCl: | 0.2N |
| Voltage applied: | 0.85 V |
| Reaction temperature: | 30° C. |

TABLE 3

| Example No. | Concentration of HCl (N) | Avg. cathode current density (mA/cm$^2$) |
|---|---|---|
| 12 | 2 | 87.31 |
| 13 | 3 | 79.3 |
| 14 | 5 | 75.97 |
| 15 | 7 | 69.04 |
| 16 | 8 | 67.23 |

Example 17-19

According to the present invention, all experiments were carried out in an electrochemical cell. The circulation of electrolyte was supplied using peristaltic pump. The results for variation of voltage are presented in Table 4. The reactions are performed in the following operating conditions:

| | |
|---|---|
| Surface area ratio of anode to cathode: | 5:1 |
| Distance between electrodes: | 3.5 cm |
| Concentration of HCl: | 4N |
| Concentration of CuCl: | 0.2N |
| Reaction temperature: | 30° C. |

TABLE 4

| Example No. | Voltage (V) | Avg. cathode current density (mA/cm$^2$) |
|---|---|---|
| 17 | 0.6 | 50.29 |
| 18 | 0.8 | 70.37 |
| 19 | 1.0 | 87.31 |

Example 20-24

According to the present invention, all experiments were carried out in an electrochemical cell. The circulation of electrolyte was supplied using peristaltic pump. The results for variation of flow rate of electrolyte are presented in Table 5. The reactions are performed in the following operating conditions:

| | |
|---|---|
| Surface area ratio of anode to cathode: | 8:1 |
| Distance between electrodes: | 4.5 cm |
| Concentration of HCl: | 6.5N |
| Concentration of CuCl: | 0.2N |
| Voltage: | 0.6 V |
| Reaction temperature: | 30° C. |

TABLE 5

| Example No. | Flow rate of electrolyte (ml/min) | Avg. cathode current density (mA/cm$^2$) |
|---|---|---|
| 20 | 125 | 50.29 |
| 21 | 175 | 51.88 |
| 22 | 200 | 58.33 |
| 23 | 250 | 70.37 |
| 24 | 125c, 250a | 59.99 |

The symbols used in Table 5 have the following meanings:
c = catholyte side flow rate, a = anolyte flow rate Example 25-27

According to the present invention, all experiments were carried out in an electrochemical cell. The circulation of electrolyte was supplied using peristaltic pump. The results for variation of concentration of CuCl are presented in Table 6. The reactions are performed in the following operating conditions:

| | |
|---|---|
| Surface area ratio of anode to cathode: | 10:1 |
| Distance between electrodes: | 3.5 cm |
| Concentration of HCl: | 4N |
| Voltage: | 0.7 V |
| Reaction temperature: | 30° C. |

TABLE 6

| Example No. | Concentration of CuCl (N) | Avg. cathode current density (mA/cm$^2$) |
|---|---|---|
| 25 | 0.1 | 70.37 |
| 26 | 0.4 | 92.35 |
| 27 | 0.8 | 106.21 |

Example 28-31

According to the present invention, all experiments were carried out in an electrochemical cell. The circulation of electrolyte was supplied using peristaltic pump. The results for variation of reaction temperature are presented in Table 7. The reactions are performed in the following operating conditions:

| | |
|---|---|
| Surface area ratio of anode to cathode: | 8:1 |
| Distance between electrodes: | 3.5 cm |
| Concentration of HCl: | 2.36N |
| Concentration of CuCl: | 0.4N |
| Voltage: | 0.9 V |
| Reaction temperature: | 30° C. |

TABLE 7

| Example No. | Reaction temperature (° C.) | Avg. cathode current density (mA/cm$^2$) |
|---|---|---|
| 28 | 20 | 67.38 |
| 29 | 30 | 70.37 |
| 30 | 45 | 84.63 |
| 31 | 60 | 98.23 |

We claim:

1. A process for electrolysis of cuprous chloride to produce copper, comprising the steps of:

a) contacting at least one anode and at least one cathode of an electrochemical cell with an electrolyte in a compartment wherein the anode and the cathode are separated by an ion exchange membrane; and b) applying a voltage between the anode and the cathode to produce copper, wherein the electrolyte is cuprous chloride in hydrochloric acid of 0.1 N to 6 N concentration and the anode to cathode surface area ratio is in the range of 5:1 to 30:1.

2. The process for electrolysis of cuprous chloride as claimed in claim 1, wherein the membrane is placed at distance 0.05 cm to 90 cm from electrodes.

3. The process for electrolysis of cuprous chloride as claimed in claim 1, wherein electrolyte is cuprous chloride in hydrochloric acid having CuCl concentration in the range of 0.1 N to 1.0 N or between 0.1 N to 0.8 N and all other concentrations of CuCl where CuCl is completely soluble in hydrochloric acid.

4. The process for electrolysis of cuprous chloride as claimed in claim 1, wherein the applied voltage is in the range of 0.4 V to 1.0 V or in the range of 0.5 V to 1.1 V.

5. The process for electrolysis of cuprous chloride as claimed in claim 1, wherein electrolysis is carried out at current density ranging from 1 mA/cm$^2$ to 1000 mA/cm$^2$ or ranging from 100 mA/cm$^2$ to 125 mA/cm$^2$.

6. The process for electrolysis of cuprous chloride as claimed in claim 1, wherein electrolyte has particle Reynolds number in the range of 10 to 500 or in the range of 50 to 300.

7. The process for electrolysis of cuprous chloride as claimed in claim 1, wherein electrolysis is carried out at temperature in the range of 0° C. to 90° C. or at 30° C.

8. The process for electrolysis of cuprous chloride as claimed in claim 1, wherein anode and cathode have surface area ratio preferably 8:1.

9. The process for electrolysis of cuprous chloride as claimed in claim 1, wherein the distance between electrodes is preferably in the range 1 cm to 5 cm.

10. The process of claim 1, wherein the copper is in the form of a copper powder, and wherein the copper powder is 99.99% pure;

and the size of particles of the copper powder is in the range of 6-30 μm.

11. The process of claim 1, wherein the anode to cathode surface area ratio is in the range of 5:1 to 15:1.

12. An electrochemical cell for production of copper from cuprous chloride comprising:

at least one anode disposed in an electrolyte;

at least one cathode disposed in the electrolyte;

at least one compartment for the anode and cathode;

an ion exchange membrane disposed between the anode compartment and cathode compartment;

wherein the electrolyte is cuprous chloride in hydrochloric acid of 0.1 N to 6 N concentration and anode to cathode surface area ratio in the range of 5:1 to 30:1 and the distance between electrodes is in the range of 0.01 cm to 100 cm.

13. The electrochemical cell as claimed in claim 12 wherein the electrochemical cell is composed of corrosion resistant non-conductive material selected from ceramic, thermoplastic polymeric material and thermoset polymeric material, or a conductive material coated with a non-conductive material selected from ceramic, thermoplastic polymeric material and thermoset polymeric material.

14. The electrochemical cell according to claim 12, wherein an anode and cathode are composed of a material selected from a corrosion resistant conductive metal and a conductive carbon material.

15. The electrochemical cell according to claim 12, wherein an anode is composed of conductive material selected from the group consisting of platinum, palladium, ruthenium, iridium, osmium, rhodium and graphite.

16. The electrochemical cell according to claim 12, wherein a cathode is conductive material selected from the group consisting of copper, platinum, palladium, ruthenium, iridium, osmium, rhodium and graphite.

17. The electrochemical cell according to claim 12, wherein the surface area ratio of anode to cathode is 8:1.

18. The electrochemical cell according to claim 12, wherein the hydrochloric acid has a concentration of 2.36 N.

19. The electrochemical cell as claimed in claim 12, wherein the electrolyte is cuprous chloride in hydrochloric acid having a CuCl concentration in the range of 0.1 N to 1.0 N, or in the range of 0.1 N to 0.8 N, and all other concentration of CuCl where CuCl is completely soluble in the hydrochloric acid.

20. The electrochemical cell as claimed in claim 12, wherein the applied voltage is in the range of 0.4 V to 1.5 V, or in the range of 0.5 V to 1.1 V.

21. The electrochemical cell as claimed in claim 12, wherein electrolysis is carried out at a current density ranging from 1 mA/cm$^2$ to 1000 mA/cm$^2$, or ranging from 100 mA/cm$^2$ to 125 mA/cm$^2$.

22. The electrochemical cell as claimed in claim 12, wherein the electrolyte has a particle Reynolds number in the range of 10 to 500, or in the range of 50 to 300.

23. The electrochemical cell as claimed in claim 12, wherein electrolysis is carried out at temperature in the range of 0° C. to 90° C., or in the range of 10° C. to 45° C.

24. The electrochemical cell of claim 12, wherein the copper is in the form of a copper powder, and wherein the copper powder is 99.99% pure;

and the size of particles of the copper powder is in the range of 6-30 μm.

25. The electrochemical cell of claim 12, wherein the anode to cathode surface area ratio is in the range of 5:1 to 15:1.

* * * * *